US010669925B2

(12) United States Patent
Soto Infante et al.

(10) Patent No.: US 10,669,925 B2
(45) Date of Patent: Jun. 2, 2020

(54) VEHICLE FAN SHROUD DE-ICING ASSEMBLY

(71) Applicant: Nissan North America, Inc., Franklin, TN (US)

(72) Inventors: Amilkar Abraham Soto Infante, Estado de Mexico (MX); Xavier Ramiro Velazquez, Mexico City (MX)

(73) Assignee: Nissan North America, Inc., Franklin, TN (US)

( * ) Notice: Subject to any disclaimer, the term of this patent is extended or adjusted under 35 U.S.C. 154(b) by 59 days.

(21) Appl. No.: 15/799,334

(22) Filed: Oct. 31, 2017

(65) Prior Publication Data

US 2019/0128285 A1 May 2, 2019

(51) Int. Cl.

| | |
|---|---|
| ***F01P 11/20*** | (2006.01) |
| ***F04D 29/58*** | (2006.01) |
| ***F04D 25/08*** | (2006.01) |
| ***F01P 11/10*** | (2006.01) |
| ***F01P 7/16*** | (2006.01) |
| ***F01P 5/06*** | (2006.01) |
| *F04D 29/52* | (2006.01) |
| *F01P 7/14* | (2006.01) |

(52) U.S. Cl.

CPC ..... *F01P 11/20* (2013.01); *F01P 5/06* (2013.01); *F01P 7/16* (2013.01); *F01P 11/10* (2013.01); *F04D 25/082* (2013.01); *F04D 29/5853* (2013.01); *F01P 2007/146* (2013.01); *F01P 2060/18* (2013.01); *F01P 2070/04* (2013.01); *F01P 2070/50* (2013.01); *F04D 29/522* (2013.01)

(58) Field of Classification Search

CPC .... F01P 2070/04; F01P 2070/05; F28F 17/00; F28F 19/006; F04D 25/082; F04D 29/5826; F04D 29/584; F04D 29/5853

USPC ..... 416/196 A

See application file for complete search history.

(56) References Cited

U.S. PATENT DOCUMENTS

| | | | | |
|---|---|---|---|---|
| 4,519,213 A * | 5/1985 | Brigham | F17C 9/02 | 62/434 |
| 5,275,538 A * | 1/1994 | Paliwoda | F04D 13/021 | 123/41.46 |
| 5,755,380 A * | 5/1998 | Virey | B60H 1/034 | 237/12.3 R |
| 6,908,283 B2 * | 6/2005 | Soofer | F01P 11/029 | 415/215.1 |
| 2004/0134995 A1 | 7/2004 | Keeler | | |

(Continued)

FOREIGN PATENT DOCUMENTS

JP 2001-310640 A 11/2001

*Primary Examiner* — Erick R Solis
*Assistant Examiner* — Robert A Werner
(74) *Attorney, Agent, or Firm* — Global IP Counselors, LLP

(57) ABSTRACT

A vehicle fan shroud de-icing assembly includes a vehicle radiator, a fan shroud installed to the radiator, a fan and a heat providing member. The fan is installed to the fan shroud adjacent to the radiator and is configured to selectively move air between heat transferring fins of the radiator. The heat providing member is attached to one of the radiator and the fan shroud. The heat providing member is positioned and configured to provide heat to the fan shroud and/or radiator in order to melt ice, show and shush retained within the fan shroud or on surfaces of the radiator.

15 Claims, 11 Drawing Sheets

(56) References Cited

U.S. PATENT DOCUMENTS

| | | | | |
|---|---|---|---|---|
| 2010/0275862 | A1* | 11/2010 | Cassell, Jr. | F02M 35/06 123/41.57 |
| 2014/0318749 | A1* | 10/2014 | Katoh | B60H 1/00328 165/140 |
| 2017/0022876 | A1* | 1/2017 | Hoshi | B60K 11/04 |
| 2018/0117985 | A1* | 5/2018 | Kim | B60H 1/00385 |

* cited by examiner

VEHICLE FAN SHROUD DE-ICING ASSEMBLY

BACKGROUND

Field of the Invention

The present invention generally relates to a vehicle fan shroud de-icing assembly. More specifically, the present invention relates to a vehicle fan shroud de-icing assembly installed to a vehicle radiator that provides heat to an area of a fan shroud adjacent to the vehicle radiator in order to melt snow, ice and/or slush prior when the radiator is in a non-heated state.

Background Information

Vehicle radiators typically include a fan shroud and an electric fan. The electric fan is operated to aid in the transfer of heat away from the radiator, thereby dissipating heat from a vehicle engine connected thereto. In winter weather conditions, ice, snow and/or slush can collect in areas of the fan shroud within a movement path of the blades of the fan, and can interfere with fan operation once the engine has fully warmed up.

SUMMARY

One object of the present disclosure is to provide a fan shroud assembly with a heat providing member that melts snow, ice and/or slush within the fan shroud assembly when the engine is operating but has not yet warmed up sufficiently to provide heated coolant to the vehicle radiator.

In view of the state of the known technology, one aspect of the present disclosure is to provide a vehicle fan shroud de-icing assembly with a vehicle radiator, a fan shroud, a fan and a heat providing member. The fan shroud is installed to the radiator. The fan is installed to the fan shroud and is configured to selectively move air between heat transferring fins of the radiator. The heat providing member is attached to one of the radiator and the fan shroud. The heat providing member is positioned and configured to provide heat to the fan shroud and/or radiator in order to melt ice, show and/or shush retained within the fan shroud and/or on the radiator.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
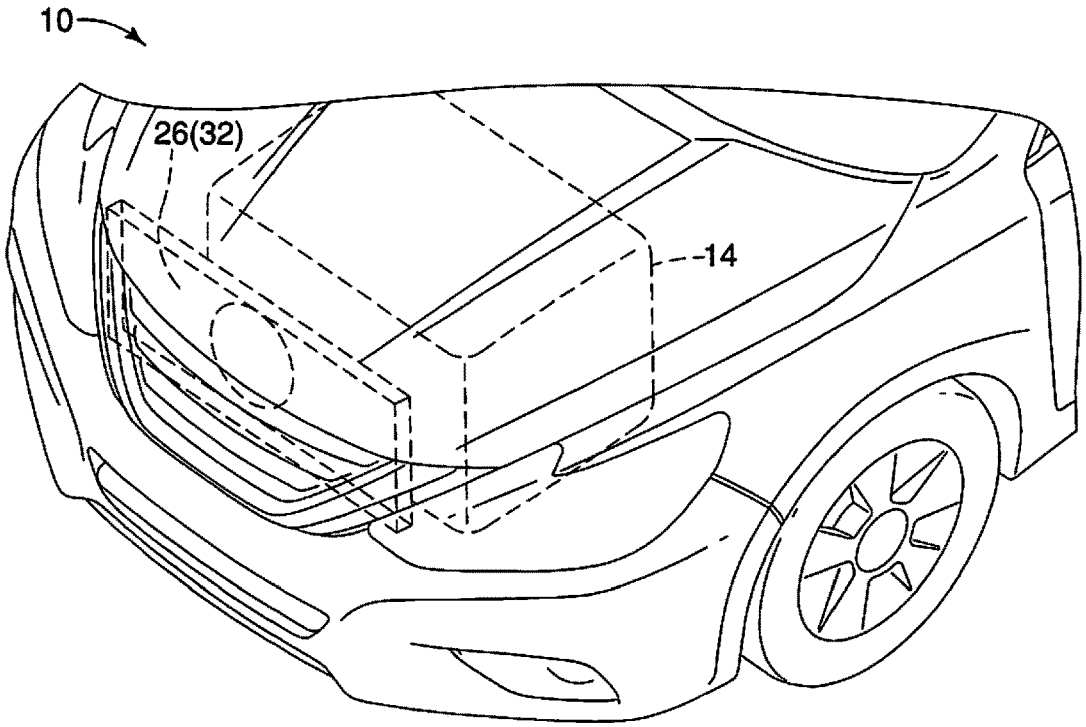
FIG. 1 is a perspective view of a vehicle that includes an engine, a radiator and a fan shroud in accordance with a first embodiment.
Figure 2:
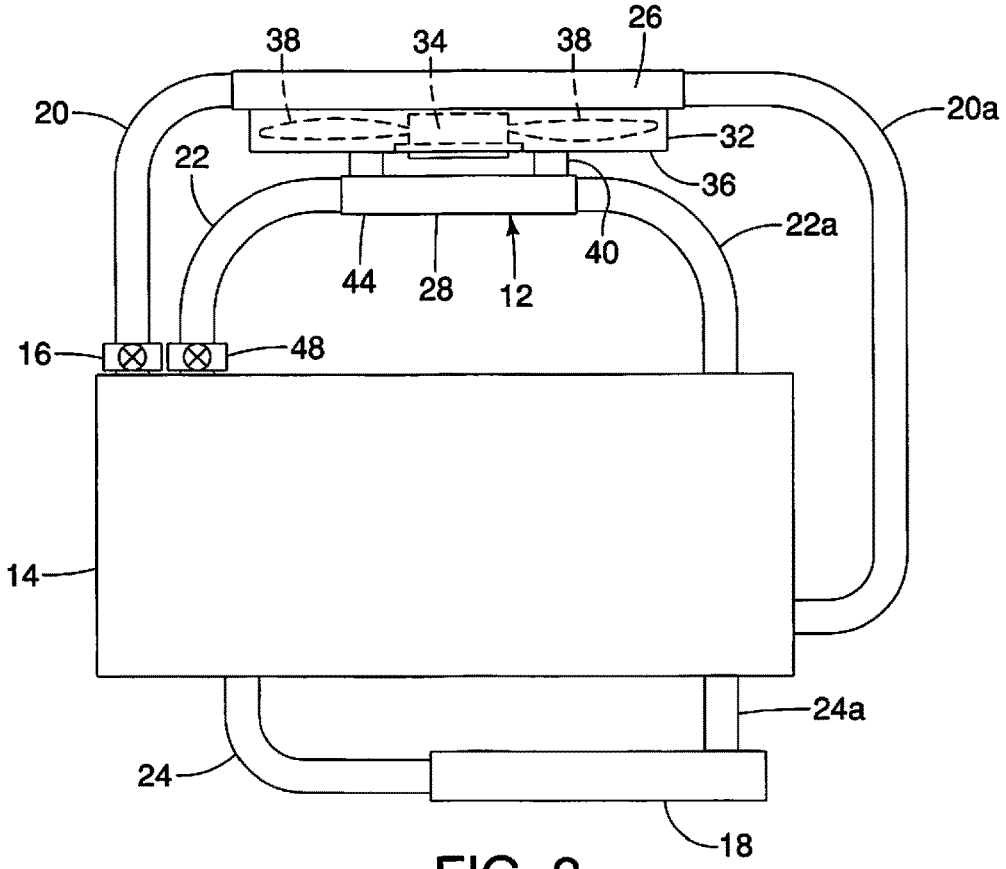
FIG. 2 is a schematic view of the engine, the radiator, portions of a cooling system of the engine and the fan shroud, further showing a vehicle fan shroud de-icing assembly in accordance with the first embodiment.

Referring initially to FIGS. 1 and 2, a vehicle 10 that includes a fan shroud de-icing assembly 12, is illustrated in accordance with a first embodiment.

The vehicle 10 includes many conventional components, such as an internal combustion engine 14. As shown schematically in FIG. 2, the engine 14 includes a cooling system defined by, for example, various coolant ports (see FIG. 9) within the engine 14, a water pump (see FIG. 9) that circulates coolant to, from and through the coolant ports of the engine 14, a thermostatic valve 16, a heater core 18, various hoses 20, 20*a*, 22, 22*a*, 24 and 24*a*, and a radiator 26, among other elements and components. As shown in FIG. 2, the hoses 20, 20*a*, 22, 22*a*, 24 and 24*a* connect the engine 14 with the thermometer 20, the heater core 18 and the radiator 26. The heater core 18 is installed within the vehicle 10 in order to provide heat to a passenger compartment of the vehicle 10. The engine 14 and its ports, the thermostatic valve 16, the heater core 18, the various hoses 20, 20*a*, 22, 22*a*, 24 and 24*a*, the radiator 26 and the water pump (FIG. 9) are all conventional vehicle components. Therefore, further description of these components is omitted for the sake of brevity, except where necessary to understand the operation of the fan shroud de-icing assembly 12.

The fan shroud de-icing assembly 12 includes an electric fan assembly 30 mounted to one side of the radiator 26 and a heat providing member 28. The electric fan assembly 30 includes a shroud 32 attached to the radiator 26 by mechanical fasteners (not shown) and an electric fan 34 (also referred to as a fan assembly) mounted or installed to the shroud 32 via mechanical fasteners (not shown). The shroud 32 defines a fan receiving space 36 that is cylindrically shaped and is dimensioned such that blades 38 of the electric fan 34 can rotate freely within the fan receiving space 36. The fan 34 is configured to selectively move air between heat transferring fins of the radiator 26, thereby assisting in the dissipation of heat from coolant circulating through the radiator 26 in a conventional manner. Specifically, the electric fan 34 defines an airflow direction when operating defining upstream and downstream relative to the airflow direction. The heat providing member 28 is located on the downstream side of the radiator 26. Since shrouds and electric fans used with a vehicle radiator for cooling the radiator are conventional vehicle components, further description is omitted for the sake of brevity.

Figure 3:
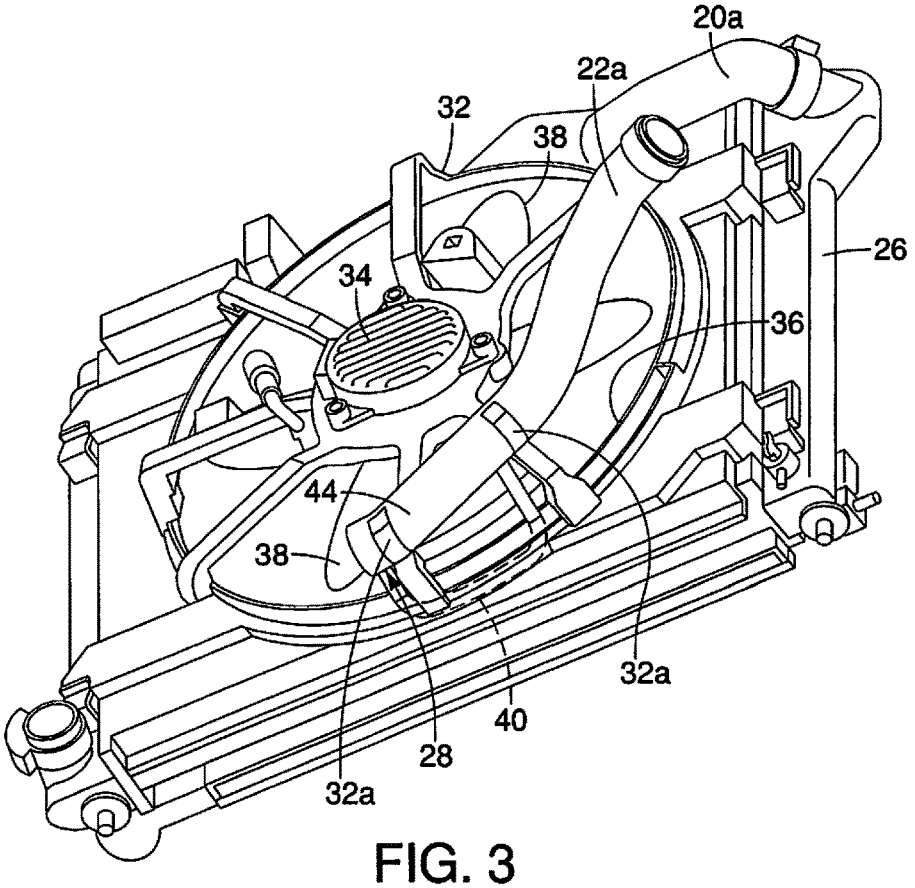
FIG. 3 is a perspective view of an underside of the radiator and the fan shroud showing a heat providing member of the vehicle fan shroud de-icing assembly, with a portion of the heat providing member extending into a fan receiving space within the fan shroud in accordance with the first embodiment.
Figure 4:
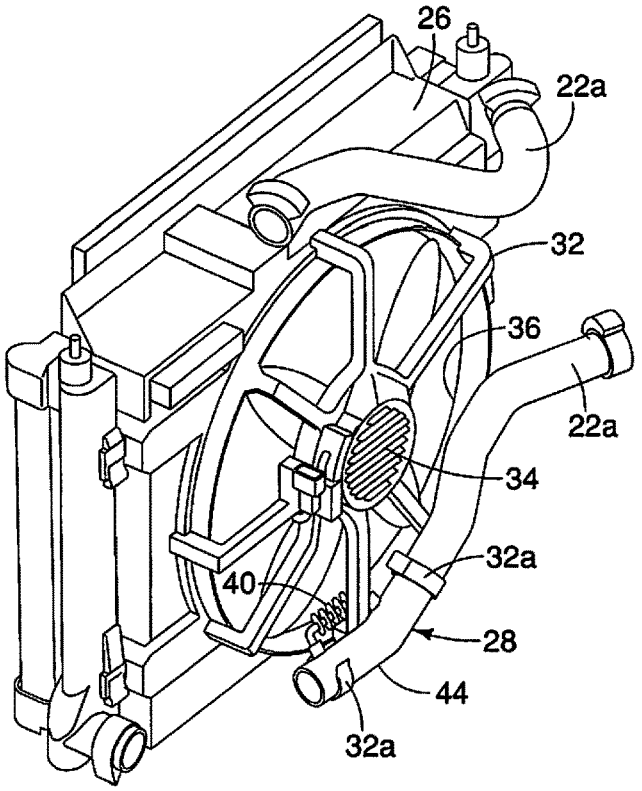
FIG. 4 is a perspective view of an upper side of the radiator and the fan shroud showing the heat providing member of the vehicle fan shroud de-icing assembly, with the portion of the heat providing member extending into the fan receiving space within the fan shroud in accordance with the first embodiment.
Figure 5:
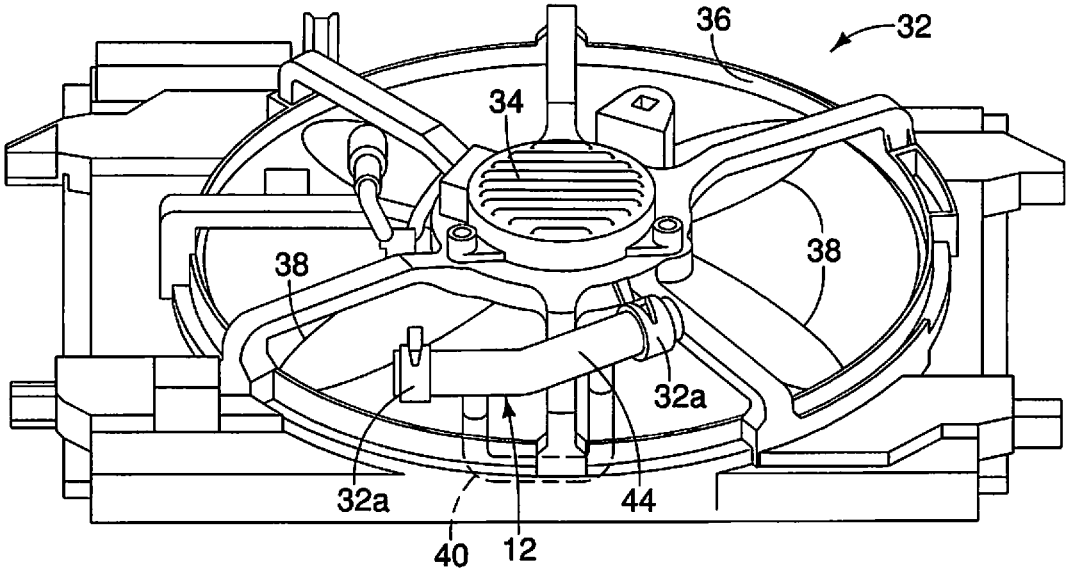
FIG. 5 is a perspective view of a bottom side of the radiator and the fan shroud showing the heat providing member of the vehicle fan shroud de-icing assembly, with the portion of the heat providing member extending into the fan receiving space within the fan shroud in accordance with the first embodiment.
Figure 6:
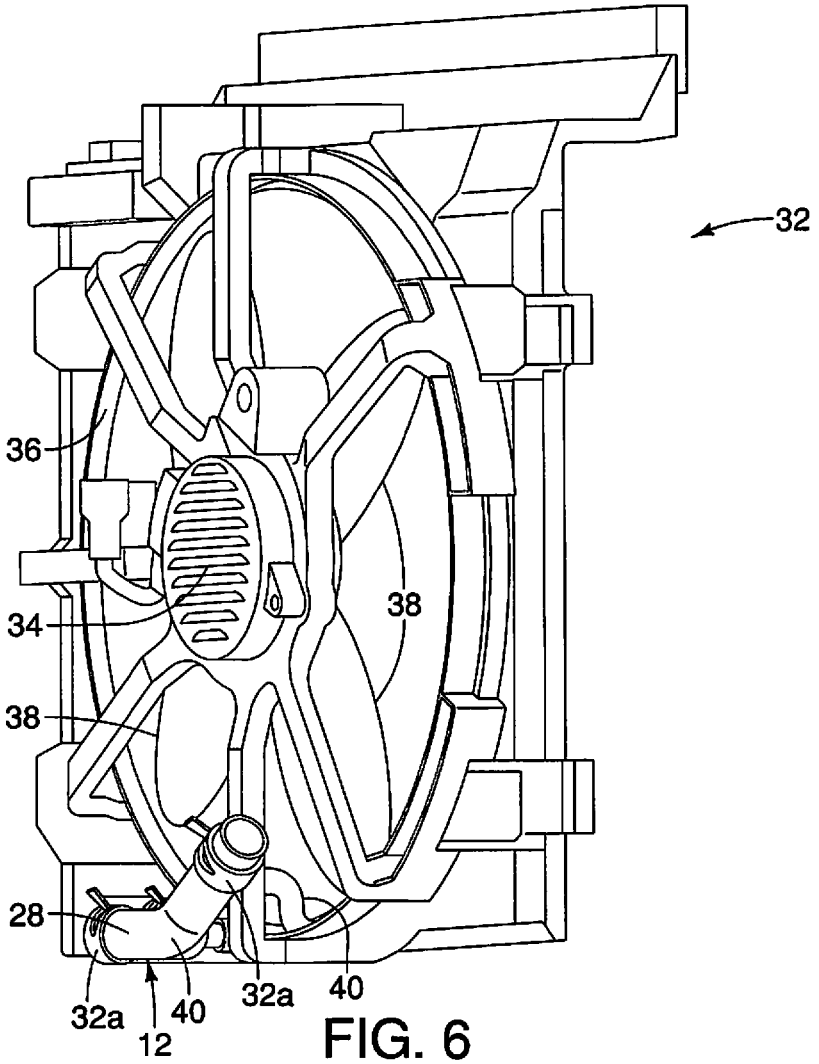
FIG. 6 is a perspective view of a lateral side of the radiator and the fan shroud showing the heat providing member of the vehicle fan shroud de-icing assembly, with the portion of the heat providing member extending into the fan receiving space within the fan shroud in accordance with the first embodiment.

As shown in FIGS. 3 and 4, the heat providing member 28 is mounted to the shroud 32 by clamps or projections 32*a* such that at least a portion 40 of the heat providing member 28 extends into the fan receiving space 36 of the shroud 32. Specifically, the portion 40 of the heat providing member 28 within the fan receiving space 36 is provided with heat in order to melt ice, snow and/or slush that might accumulate within the fan receiving space 36 as a result of winter weather conditions.

Figure 7:
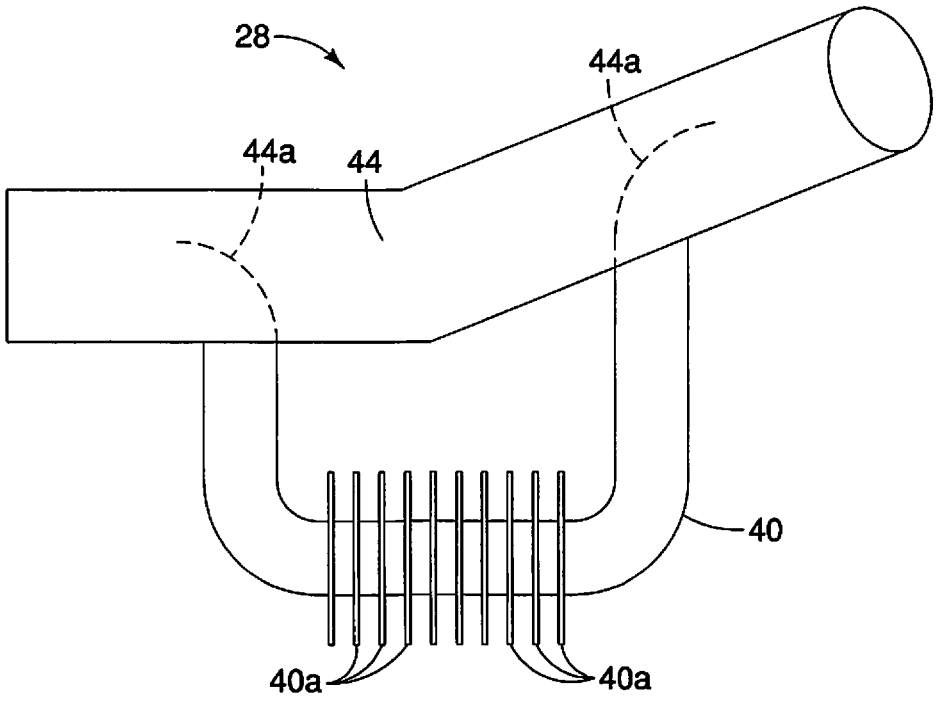
FIG. 7 is a top view of the heat providing member shown removed from the fan shroud showing a coolant flow pipe of the heat providing member with the portion of the heat providing member extending from the coolant flow pipe with several heat transferring fins extending from the portion of the heat providing member in accordance with the first embodiment.
Figure 8:
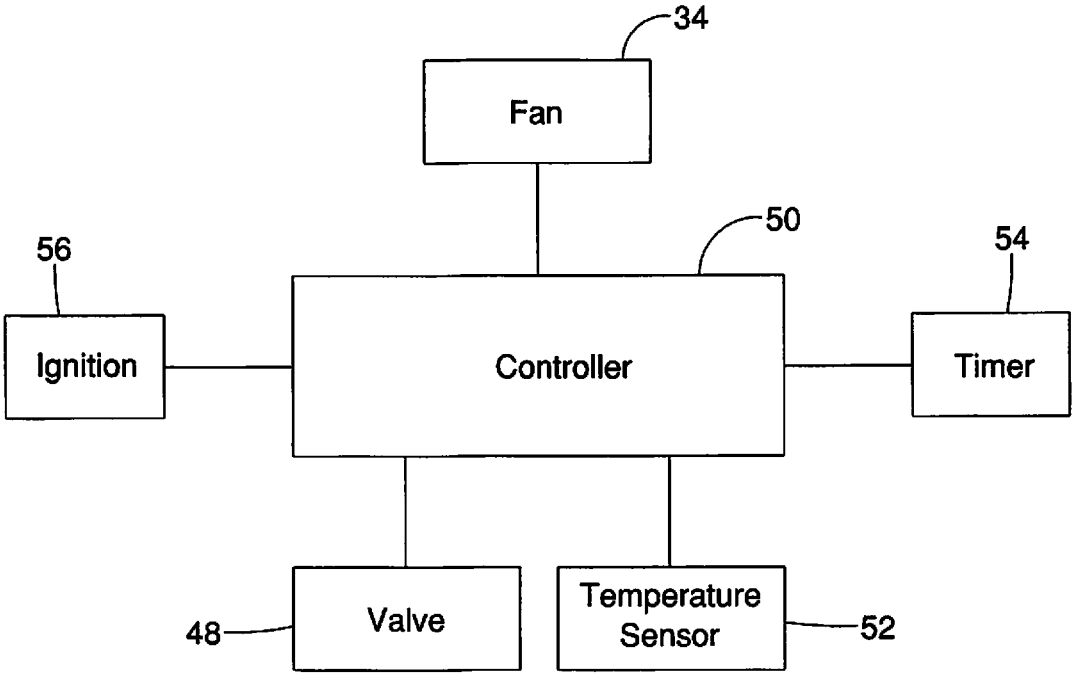
FIG. 8 is a block diagram of a control system including a controller, a temperature sensor, a fan of the fan shroud and a control valve configured to control flow of coolant to the coolant flow pipe of the heat providing member in accordance with the first embodiment.
Figure 9:
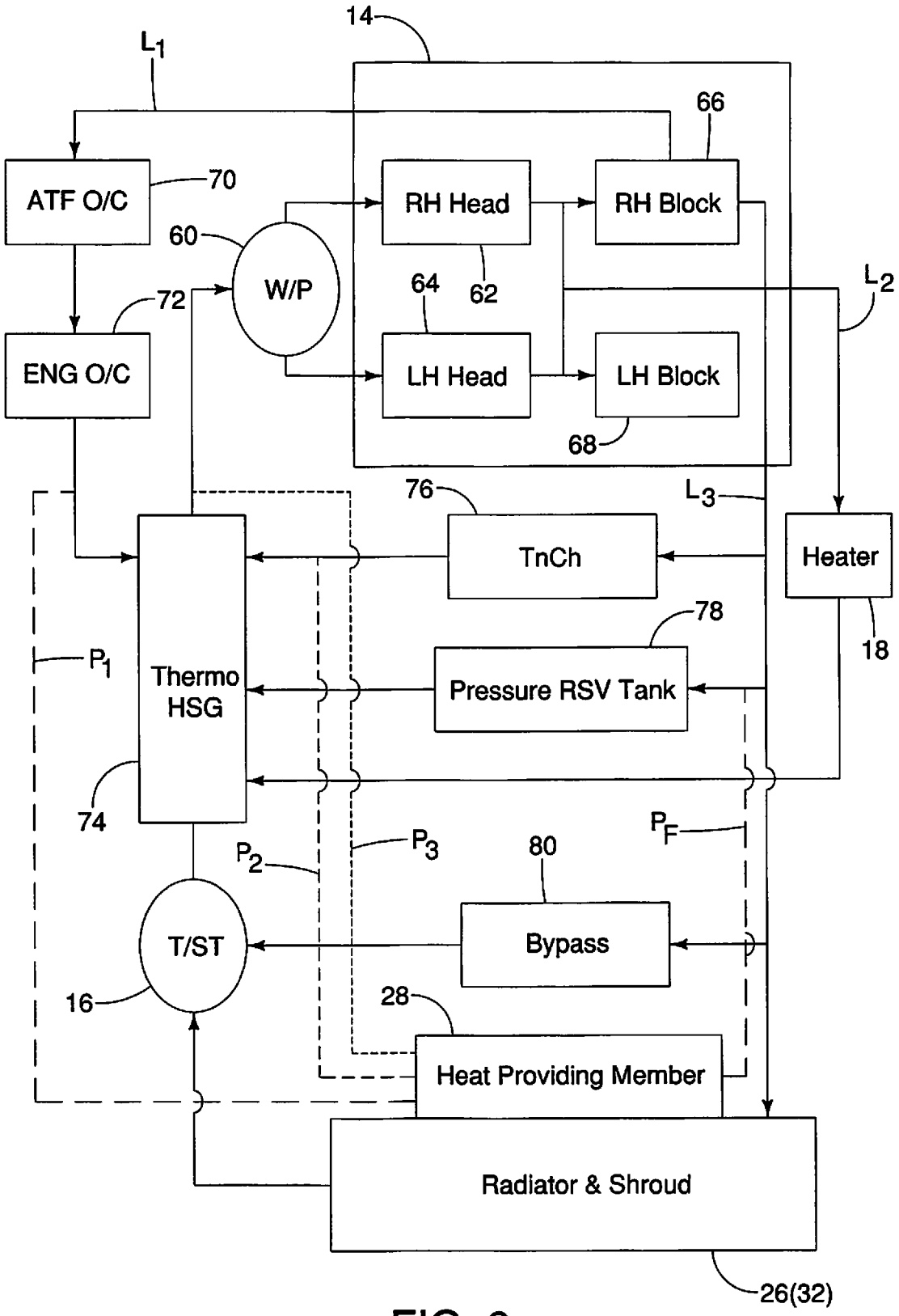
FIG. 9 is a schematic block diagram of the cooling system of the engine showing a plurality of different flow path employable to provide coolant to the coolant flow pipe of the heat providing member in accordance with the first embodiment.

In the first embodiment depicted in FIGS. 2-9, the heat providing member 28 is basically a coolant flow pipe 44 connected to the ports and/or coolant passageways of the engine 14 as shown in FIGS. 2 and 9, and is therefore configured to receive coolant flowing from the engine 14. In other words, the coolant flow pipe 44 receives coolant from the directly from the engine 14 in a flow path that is separate from the coolant flow path of the radiator 26. Specifically, thermostatic valve 16 is connected to the engine 14 in a conventional manner receiving heated coolant from the engine 14. The hose 20 is connected to the thermostatic valve 16 and the radiator 26. When the engine 14 is below a predetermined temperature, the thermostatic valve 16 is closed, preventing coolant flow from the engine 14 to the radiator 26. When the engine 14 reaches the predetermined temperatures, the thermostatic valve 16 opens and the hose 20 directs heated coolant from the engine 14 to the radiator 26. The hose 20*a* directs cooled coolant from the radiator 26 back to the engine 14 in a conventional manner.

Coolant flows from the engine 14 along a flow path to the heat providing member 28 that is completely separate from the flow path (hoses 20 and 20*a*) of coolant from the engine 14 to the radiator 26. In other words, the coolant flow to the heat providing member 28 bypasses the flow to the radiator 26 and is not controlled by the operation of the thermostatic valve 16. More specifically, an optional de-icing valve 48 (a control valve) is connected to the engine 14 directly or indirectly (as described below with reference to FIG. 9) to receive coolant from the engine 14. The hose 22 connects the optional de-icing valve 48 to the coolant flow pipe 44 of the heat providing member 28. The hose 22*a* returns the coolant from the heat providing member 28 back to the engine 14.

As shown in FIGS. 3, 4, 5, 6 and 7, the portion 40 of the heat providing member 28 is a tube that is configured to receive coolant flowing therethrough. As shown in FIGS. 3, 4, 5 and 6, the tube defining the portion 40 extends into the fan receiving space 36, but is positioned and dimension such that it does not interfere with operation of the electric fan assembly 30.

As shown in FIGS. 4 and 7, the portion 40 can include optional heat transferring fins 40*a* extending therefrom. Further, the heat providing member 28 is installed to the fan shroud 32 below the motor of the electric fan 34. As shown in FIG. 7, a pair of baffles 44*a* can be fixed to inner surfaces of the coolant flow pip 44 that divert coolant flowing therethrough to the portion 40 of the heat providing member 28.

As shown in FIG. 8, the fan shroud de-icing assembly 12 can include an electronic controller 50 that is electronically connected to the electric fan 34, the optional de-icing valve 48, a temperature sensor 52, a timer 54 and an ignition switch 56 configured to start and shut off the engine 14. The temperature sensor 52 installed to the engine 14 at a location where the temperatures sensor 52 can measure the temperature of coolant flowing through the engine 14.

The electronic controller 50 is connected to the temperature sensor 52 and the control valve 48 and us configured to switch the control valve 48 to the open state in response to predetermined criteria related to the measured coolant temperature. Specifically, when the engine 14 is started using the ignition switch 56, the electronic controller 50 is configured to operate the control valve 48. The control valve 48 is located between the engine 14 and the coolant flow pipe 44. The control valve 48 can be switched by the electronic controller 50 between an open state allowing coolant flow from the engine 14 to the coolant flow pipe 44 and a closed state preventing coolant flow from the engine 14 to the coolant flow pipe 44.

Specifically, when the engine 14 has been started and the electronic controller 50 determines that the temperature of the coolant is below the normal operating temperature of the engine 14, the electronic controller 50 opens the control valve 48 allowing coolant from the engine 14 to flow to the coolant flow pipe 44. As the engine 14 begins to warm up, the coolant flowing through the coolant flow pipe 44 similarly warms, melting any ice, snow and/or slush that may have accumulated within the fan receiving space 36 and/or on the downstream side of the radiator 26. As the temperature of the coolant in the engine 14 increases and reaches normal operating temperature, the electronic controller 50 can continue to provide heated coolant from the engine 14 to the coolant flow pipe 44 of the heat providing member 28 for a predetermined period of time, as measured by the timer 54, and simultaneously prevent operation of the electric fan 34. This predetermined period of time ensures that once the thermostatic valve 16 has opened (as a result of the engine 14 reaching and/or exceeding normal operating temperature) and heated coolant has sufficient time to flow into the radiator 16 and warm the radiator 16 to melt any residual ice, snow and/or slush remaining within the fan receiving space 36 and/or on the radiator 26.

Once the engine 14 has reached or exceeded normal operating temperature, and the predetermined time period from the timer 54 has expired, the electric fan 34 is able to cycle on and off in accordance with conventional operation of the electric fan 34 based on, for example, engine block temperature, coolant temperature within the engine 14 and/or temperature of coolant within the radiator 26. It should be understood from the drawings and the description herein, that the operation of the electric fan 34 can be controlled by any of a variety of configurations that differ from vehicle to vehicle. The fan shroud de-icing assembly 12 can be configured to interrupt, or delay operation of the electric fan 34 when the engine 14 is warming up and has not yet reached a temperature greater than normal operating temperature of the engine 14. Further, normal operating temperature of a engine differs from engine to engine. Some engines achieve optimal operation with coolant at a temperature of 150° F., while other engines achieve optimal operation at higher temperatures of, for example, 190° F. In other words, normal operating temperature is not a fixed value, but is determined by the performance characteristics of the engine.

With the above described basic operation of the fan shroud de-icing assembly 12, ice, snow and/or slush within the fan receiving space 36 and/or on the radiator 26 is given time to soften and begin to melt thereby reducing interference with operation of the electric fan 34.

It should be understood from the drawings and the description herein that the de-icing valve 48 (the control valve) can be omitted and heated coolant can continuously be provided to the coolant flow pipe 44 while the engine 14 is operated.

FIG. 9 is a schematic view of one example of the cooling system of the engine 14, including various coolant flow paths that provide heat from coolant to various parts of the vehicle 10 and the engine 14. Specifically, the engine 14 includes a water pump 60, various coolant passageways such as a right-side head port 62, a left side head portion 64, a right-side block port 66 and a left side block port 68, with the water pump 60 circulating coolant therethrough. A portion of the coolant from the engine 14 (at the right-side block port 66) can be fed through line $L_1$ to an optional automatic transmission fluid cooler 70 and an optional engine oil cooler 72. Coolant leaving the optional automatic transmission fluid cooler 70 and the optional engine oil cooler 72 returns to a thermostat housing 74, and back to the water pump 60. Another portion of the coolant from the engine 14 can be fed through line $L_2$ to the heater core 18, and then returns to the thermostat housing 74, and back to the water pump 60. Yet another portion of the coolant from the engine 14 can be fed through line $L_3$ to a throttle body chamber 76 (part of the air intake for fuel injection), a pressure reservoir tank 78 and a bypass line 80, with each returning to the thermostat housing 74, and back to the water pump 60.

The third line $L_3$ is also connected to the radiator 26. However, the thermostatic valve 16 prevents coolant from flowing through the radiator 26 when the coolant is at or below the normal operating temperature of the engine 14. When the coolant temperature of the engine 14 is above normal operating temperature, the thermostatic valve 16 opens and coolant flows to and through the radiator 26 via the thermostat housing 74, and back to the water pump 60.

The heat providing member 28 depicted in FIG. 2-7 can be provided with coolant via any of a variety of fluid flow paths when the thermostatic valve 16 is closed. Specifically, the feed line $P_F$ can be defined by the hose 22 shown in FIG. 2. The control valve 48 shown in FIG. 2 is an optional feature can be included in or omitted from in the feed line $P_F$.

As such, with the hose 22 defining the feed line $P_F$, coolant is fed to the heat providing member 28 from the line $L_3$ directly from the engine 14. However, the hose **22*a* of FIG. 2 can correspond to any one of coolant flow paths $P_1$, $P_2$ or $P_3$. Specifically, the hose 22*a* can define the coolant flow path $P_1$. As such, the coolant flow paths $P_1$ returns coolant from the heat providing member 28 to a location downstream from the engine oil cooler 72 and directly to the thermostat housing 74. Alternatively, the hose 22*a* can define the coolant flow path $P_2$. The coolant flow path $P_2$ returns coolant directly to the water pump 60. In yet another alternative configuration, the hose 22*a* can define the coolant flow path $P_3$. The coolant flow path $P_3$ returns the coolant from the heat providing member 28 to the pressure reservoir tank 78**.

In other words, the hose 22 returns coolant from the heat providing member 28 via any one of the coolant flow path $P_1$, the coolant flow path $P_2$ or $P_3$ Thus, the fan shroud de-icing assembly 12 provides heat to a lower portion of the fan receiving space 36 of the shroud 32 while the engine 14 is operating at temperatures below normal operating temperature without coolant flow through the radiator 26.

Second Embodiment

Figure 10:
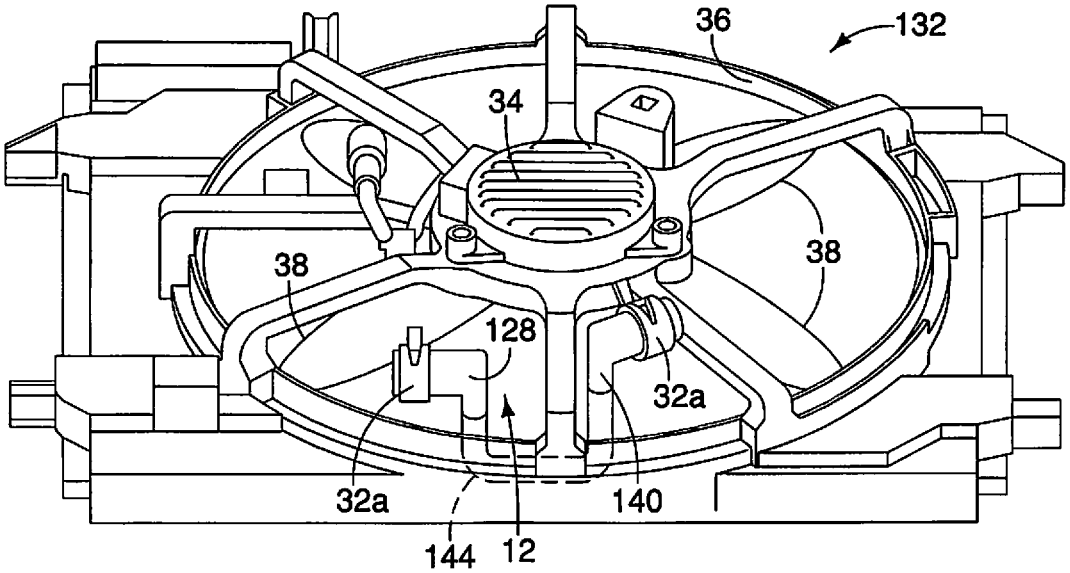
FIG. 10 is a perspective view of a bottom side of the radiator and the fan shroud showing a heat providing member of a vehicle fan shroud de-icing assembly, with a portion of the heat providing member extending into the fan receiving space within the fan shroud in accordance with a second embodiment.

Referring now to FIG. 10, a shroud 132 and a heat providing member 128 in accordance with a second embodiment will now be explained. In view of the similarity between the first and second embodiments, the parts of the second embodiment that are identical to the parts of the first embodiment will be given the same reference numerals as the parts of the first embodiment. Moreover, the descriptions of the parts of the second embodiment that are identical to the parts of the first embodiment may be omitted for the sake of brevity.

In the second embodiment, the heat providing member 128 is a single tube 144 that curves into the fan receiving space 36 and out in order to provide heat to the fan receiving space 36. The heat providing member 128 replaces the heat providing member 28 of the first embodiment. Further, the single tube 144 defines a portion 140 of the heat providing member 128.

Third Embodiment

Figure 11:
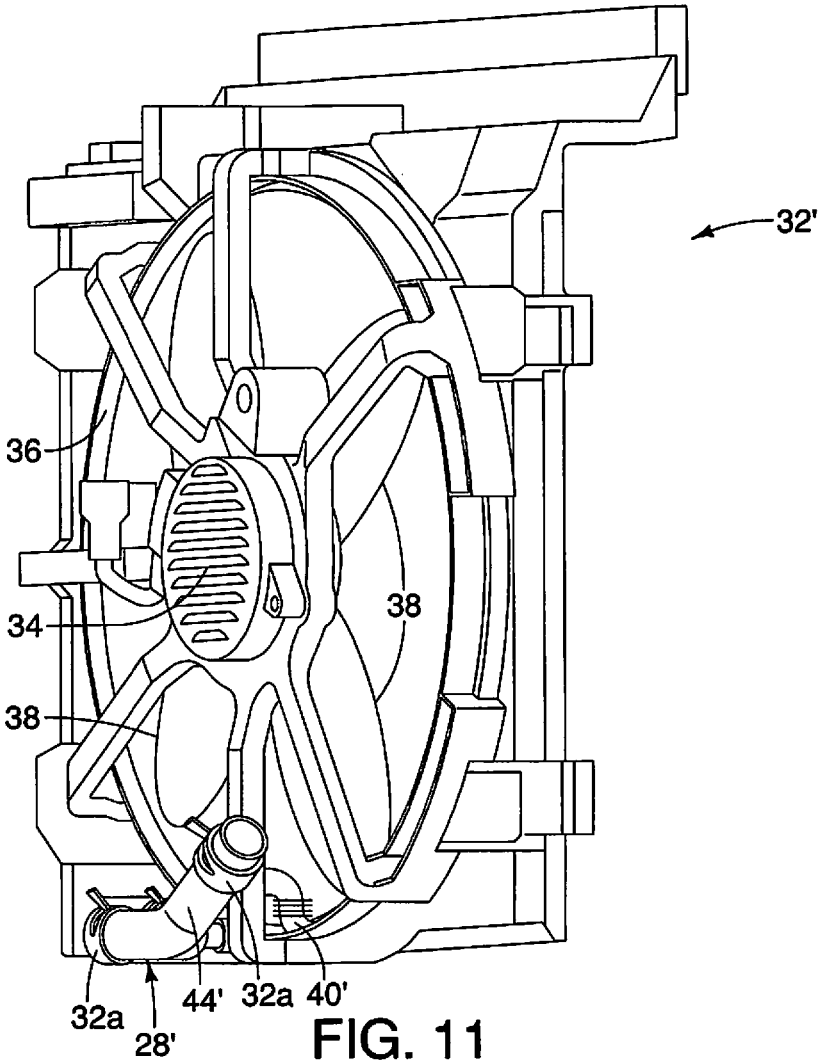
FIG. 11 is a perspective view of a lateral side of the radiator and the fan shroud showing a heat providing member of a vehicle fan shroud de-icing assembly, with a portion of the heat providing member extending into the fan receiving space within the fan shroud in accordance with a third embodiment.
Figure 12:
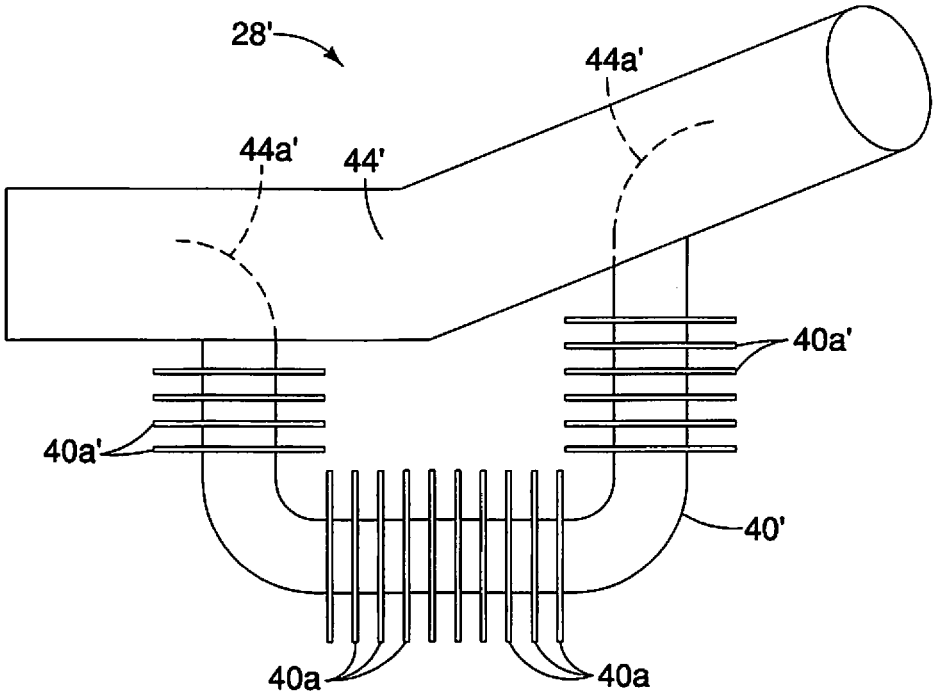
FIG. 12 is a top view of the heat providing member shown removed from the fan shroud depicted in FIG. 11, showing a coolant flow pipe of the heat providing member with the portion of the heat providing member extending from the coolant flow pipe having additional heat transferring fins in accordance with the third embodiment.

Referring now to FIGS. 11-12, a heat providing member 28' in accordance with a third embodiment will now be explained. In view of the similarity between the first and third embodiments, the parts of the third embodiment that are identical to the parts of the first embodiment will be given the same reference numerals as the parts of the first embodiment. Moreover, the descriptions of the parts of the third embodiment that are identical to the parts of the first embodiment may be omitted for the sake of brevity. The parts of the third embodiment that differ from the parts of the first embodiment will be indicated with a single prime (').

In the third embodiment, the heat providing member 28' replaces the heat providing member 28 of the first embodiment. Like the heat providing member 28 of the first embodiment, the heat providing member 28' includes a coolant flow pipe 44', and a portion 40', with fines 40*a*. However, additionally, the heat providing member 28' includes secondary heat fins 40*a'*.

Fourth Embodiment

Figure 13:
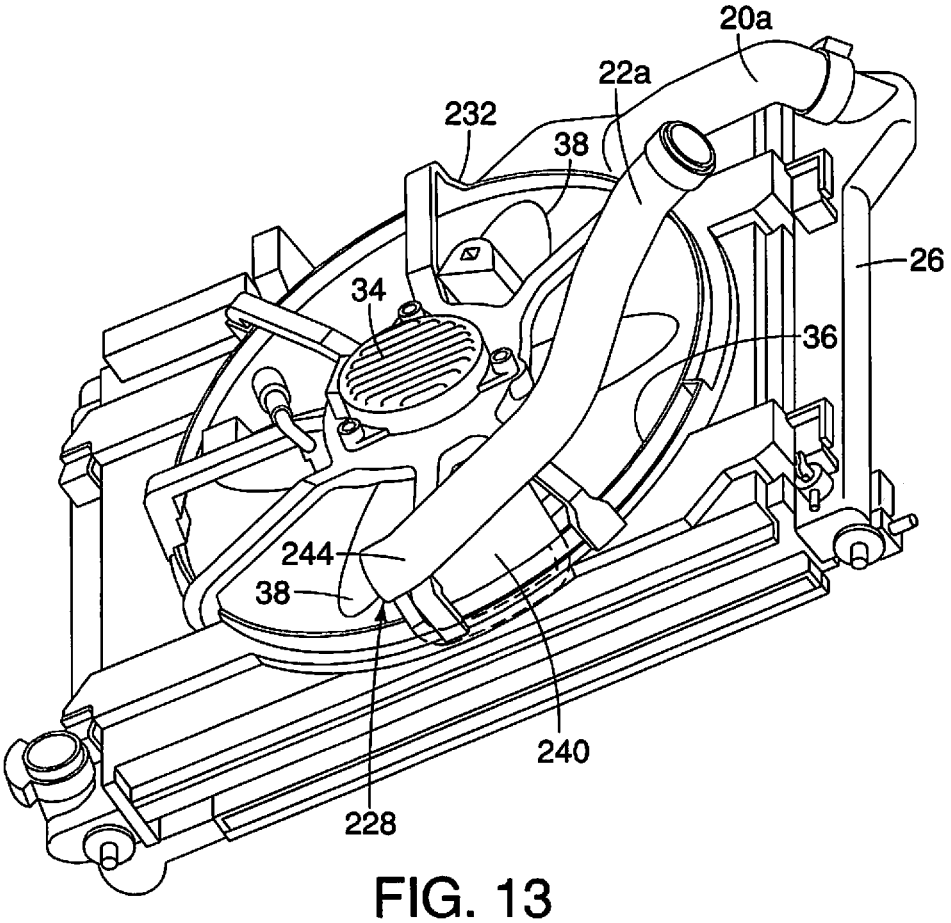
FIG. 13 is a perspective view of an underside of the radiator and the fan shroud showing a heat providing member of a vehicle fan shroud de-icing assembly, with a portion of the heat providing member extending into a fan receiving space within the fan shroud in accordance with a fourth embodiment.
Figure 14:
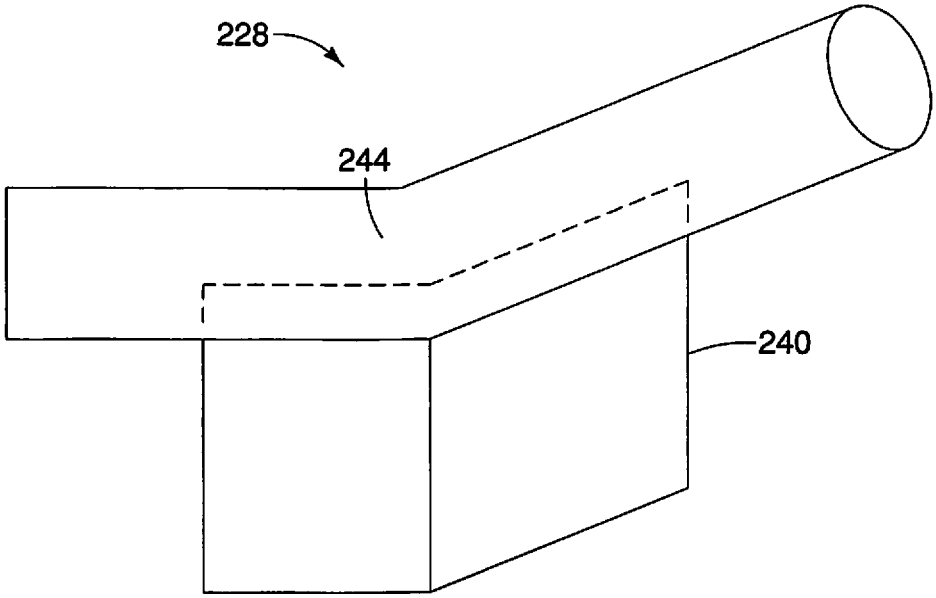
FIG. 14 is a top view of the heat providing member depicted in FIG. 13 shown removed from the fan shroud showing a coolant flow pipe of the heat providing member with the portion of the heat providing member extending from the coolant flow pipe of the heat providing member in accordance with the fourth embodiment.

Referring now to FIGS. 13-14, a heat providing member 228 in accordance with a fourth embodiment will now be explained. In view of the similarity between the first and fourth embodiments, the parts of the fourth embodiment that are identical to the parts of the first embodiment will be given the same reference numerals as the parts of the first embodiment. Moreover, the descriptions of the parts of the fourth embodiment that are identical to the parts of the first embodiment may be omitted for the sake of brevity.

In the fourth embodiment, the heat providing member 228 replaces the heat providing member 28 of the first embodiment and is installed to the shroud 32. A portion 240 of the heat providing member 228 extends into the fan receiving space 36. The heat providing member 228 includes a coolant flow pipe 244 with the portion 240 extending therefrom. The portion 240 is a solid metallic element that is welded or otherwise fixed to the coolant flow pipe 244 such that heated coolant flowing through the coolant flow pipe 244 can travel through the coolant flow pipe 244 via heat conduction to the portion 240. Since the coolant flow pipe 244 and the portion 240 are made of metal which readily conducts heat, the portion 240 within the fan receiving space 36 can heat and melt any ice, snow and/or slush that may have accumulated there as a result of winter weather conditions.

Fifth Embodiment

Referring now to FIGS. 15-18, a fan shroud de-icing system 312 in accordance with a fifth embodiment will now be explained. In view of the similarity between the first and fifth embodiments, the parts of the fifth embodiment that are identical to the parts of the first embodiment will be given the same reference numerals as the parts of the first embodiment. Moreover, the descriptions of the parts of the fifth embodiment that are identical to the parts of the first embodiment may be omitted for the sake of brevity.

In the fifth embodiment, the heat providing member 328 is an electric heater. The heat providing member 328 replaces the heat providing member 28 of the first embodiment and negates the need for the hoses 22 and 22*a*. Hence, the ports or lines providing coolant to the hoses 22 and 22*a* of the first embodiment are not necessary.

Figure 15:
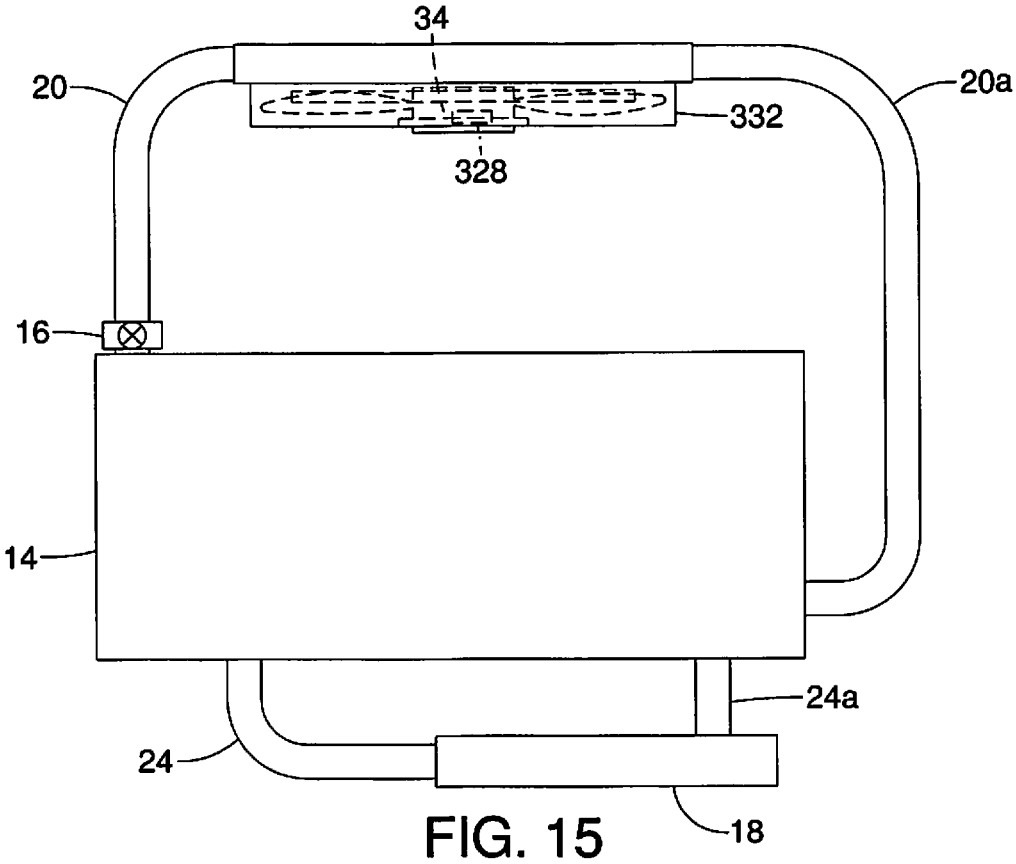
FIG. 15 is a schematic view of the engine, the radiator, portions of a cooling system of the engine and the fan shroud, further showing a vehicle fan shroud de-icing assembly in accordance with a fifth embodiment.
Figure 16:
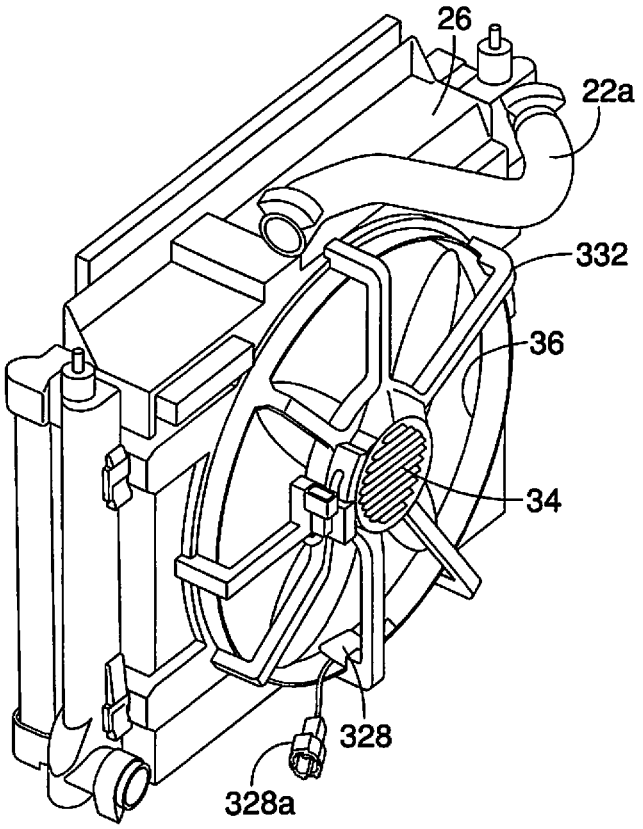
FIG. 16 is a perspective view of an upper side of the radiator and the fan shroud showing a heat providing member of the vehicle fan shroud de-icing assembly, extending into the fan receiving space within the fan shroud in accordance with the fifth embodiment.
Figure 17:
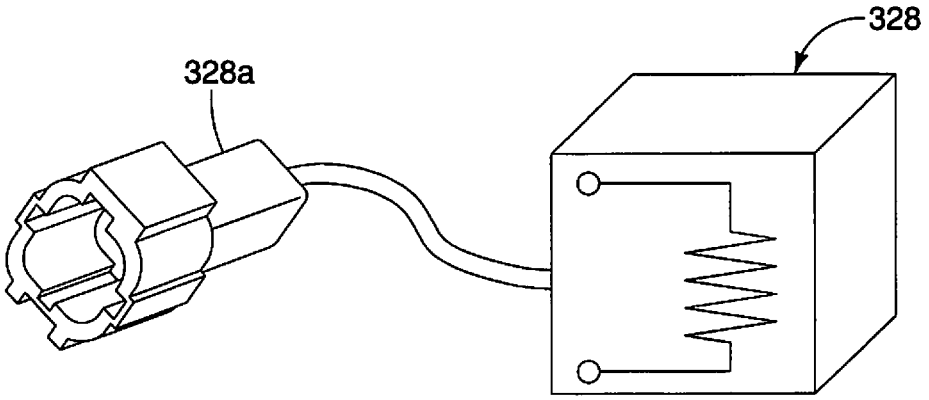
FIG. 17 is a perspective view of the heat providing member depicted in FIGS. 15 and 16 shown removed from the fan shroud in accordance with the fifth embodiment.

As shown in FIGS. 15 and 16, the electric heater that defines the heat providing member 328 is installed at the bottom (lower section) of the shroud 332 within the fan receiving space 36. The heat providing member 328 includes an electrical connector 328*a*, as shown in FIGS. 16 and 17.

Figure 18:
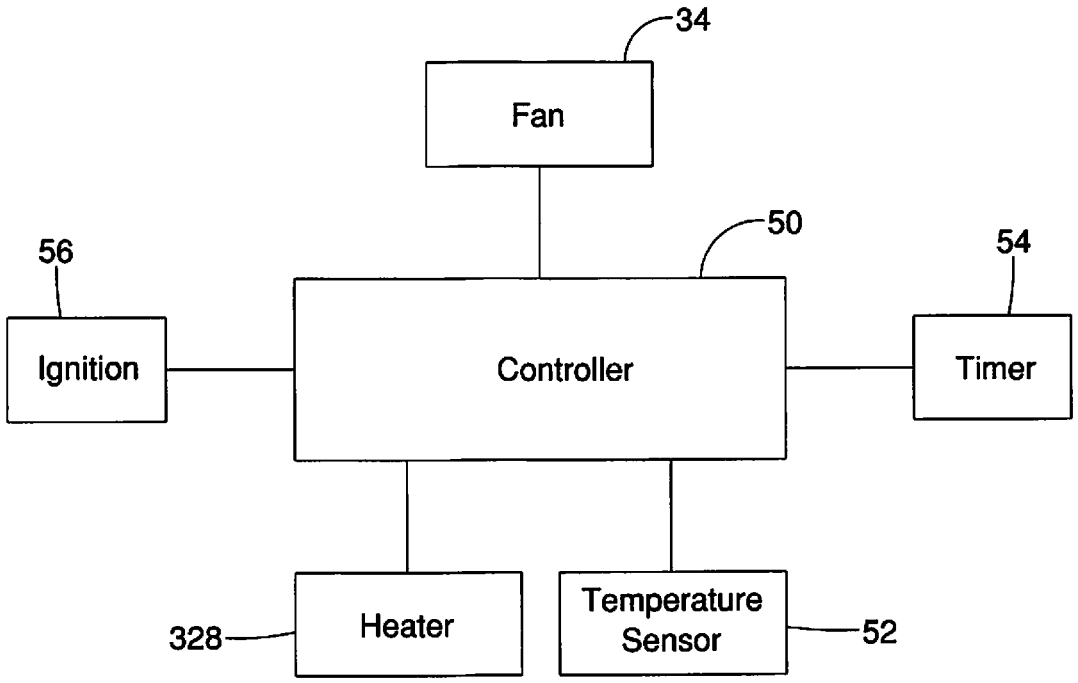
FIG. 18 is a block diagram of a control system including a controller, a temperature sensor, a fan of the fan shroud and a control valve configured to the heat providing member in accordance with the fifth embodiment.

As shown in FIG. 18, the electronic controller 50 can be connected to the fan 34, the temperature sensor 52, the timer 54, the ignition 56 of the vehicle 10 and the electric heater that defines the heat providing member 328. The electronic controller 50 is configured as described above with respect to the first embodiment, except that instead of operating the optional de-icing valve 48 of the first embodiment, the electronic controller 50 operates the electric heater that defines the heat providing member 328.

In other words, the temperature sensor 52 (a coolant temperature sensor) measures temperature of coolant flowing through the engine 14 and the electronic controller 52 operates the electric heater in response to predetermined criteria related to the measured coolant temperature within the engine 14. Alternatively, the temperature sensor 52 can measure the temperature of coolant within other portions of the cooling system of the engine 14, such as the temperature of coolant within the radiator 26.

Sixth Embodiment

Figure 19:
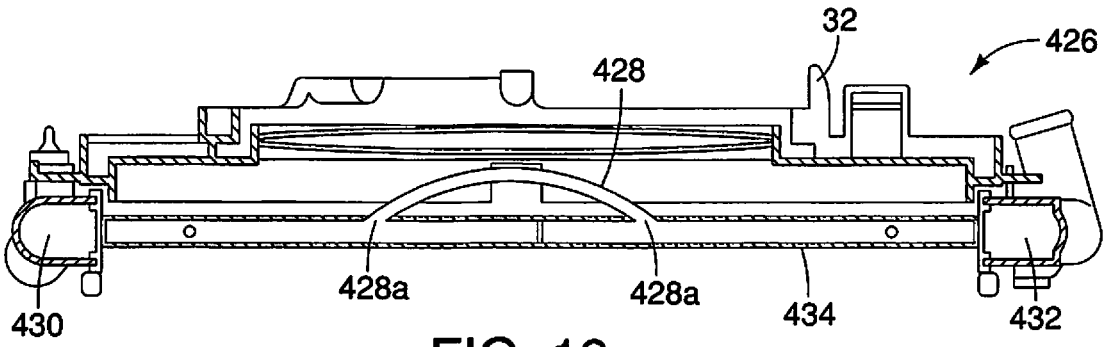
FIG. 19 is a cross-sectional view from above a lower portion of the radiator and the fan shroud showing a heat providing member extending into the fan receiving space of the fan shroud in accordance with a sixth embodiment.
Figure 20:
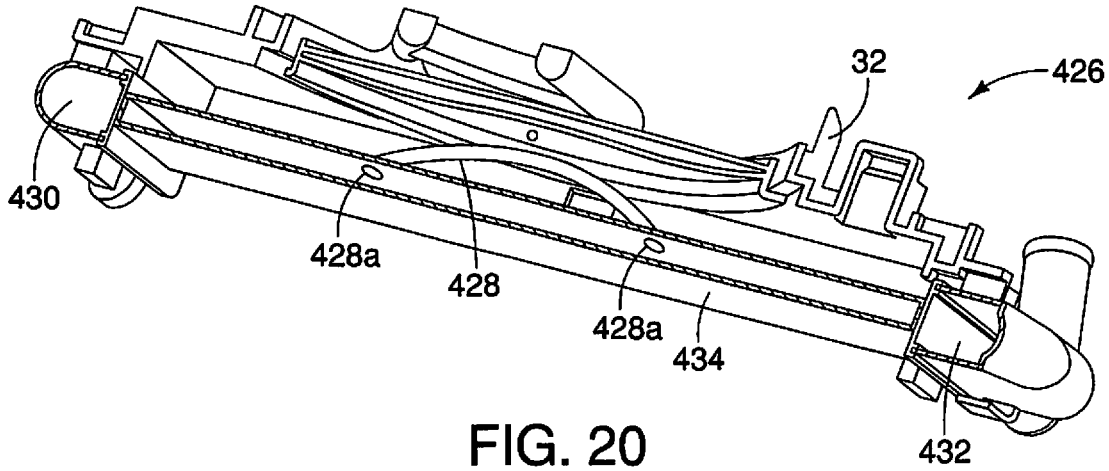
FIG. 20 is a perspective cross-sectional view from above of the lower portion of the radiator and the fan shroud showing the heat providing member extending into the fan receiving space of the fan shroud in accordance with the sixth embodiment.
Figure 21:
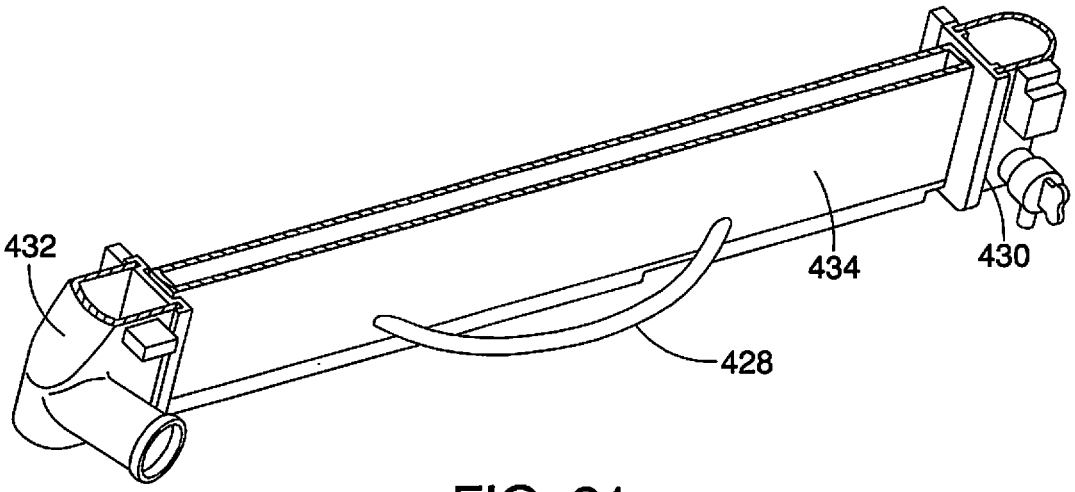
FIG. 21 is a cross-sectional view of the lower portion of the radiator with the fan shroud removed showing the heat providing member extending from the radiator in accordance with the sixth embodiment.

Referring now to FIGS. 19-21, a radiator 426 having a heat providing member 428 in accordance with a sixth embodiment will now be explained. In view of the similarity between the first and sixth embodiments, the parts of the sixth embodiment that are identical to the parts of the first embodiment will be given the same reference numerals as the parts of the first embodiment. Moreover, the descriptions of the parts of the sixth embodiment that are identical to the parts of the first embodiment may be omitted for the sake of brevity.

In the sixth embodiment, the radiator 426 includes a first side tank 430, a second side tank 432 and a lower tank 434. The heat providing member 48 receives coolant directly from the lower tank 434. The heat providing member 428 is basically a hollow tube welded to and open to portions of the lower tank 434. The lower tank 434 can be provided with coolant heated by the engine 14 separate from coolant directed to the first and second side tanks 432. In other words, the coolant flowing through the first and second side tanks 432 can be controlled by the thermostatic valve 16 (described above with respect to the first embodiment) and the lower tank 434, and hence the heat providing member 428, can receive heated coolant via the hoses 22 and 22*a* independent of thermostatic control. The heat providing member 428 (a coolant flow pipe) has a first end attached to a first lateral side of the lower tank 434 of the radiator 426 and a second end attached to a second lateral side of the lower tank 434 of the radiator 426. The heat providing member 428 can extend into the fan receiving space 36 of the fan shroud 32, or can be located below the fan shroud 32.

Alternatively, the heat providing member 428 can be a solid metal rod welded to the lower tank 434 receiving heat from coolant within the lower tank 434 via heat conduction.

The electronic controller 50 preferably includes a microcomputer with a control program that controls the control valve 48 or the electric heater 328, as discussed below. The electronic controller 50 can also include other conventional components such as an input interface circuit, an output interface circuit, and storage devices such as a ROM (Read Only Memory) device and a RAM (Random Access Memory) device.

The various vehicle structures and element other than the elements of the fan shroud de-icing assembly 12, are conventional components that are well known in the art. Since vehicle elements and components are well known in the art, these structures will not be discussed or illustrated in detail herein. Rather, it will be apparent to those skilled in the art from this disclosure that the components can be any type of structure and/or programming that can be used to carry out the present invention.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Also as used herein to describe the above embodiments, the following directional terms "forward", "rearward", "above", "downward", "vertical", "horizontal", "below" and "transverse" as well as any other similar directional terms refer to those directions of a vehicle equipped with the fan shroud de-icing assembly. Accordingly, these terms, as utilized to describe the present invention should be interpreted relative to a vehicle equipped with the fan shroud de-icing assembly.

The term "detect" as used herein to describe an operation or function carried out by a component, a section, a device or the like includes a component, a section, a device or the like that does not require physical detection, but rather includes determining, measuring, modeling, predicting or computing or the like to carry out the operation or function.

The term "configured" as used herein to describe a component, section or part of a device includes hardware and/or software that is constructed and/or programmed to carry out the desired function.

The terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such features. Thus, the foregoing descriptions of the embodiments according to the present invention are provided for illustration only, and not for the purpose of limiting the invention as defined by the appended claims and their equivalents.

What is claimed is:

1. A vehicle fan shroud de-icing assembly, comprising:

a vehicle engine;

a vehicle radiator connected to the vehicle engine via coolant hoses that direct coolant to and from the vehicle engine;

a fan shroud installed to the radiator;

a fan installed to the fan shroud and configured to selectively move air between heat transferring fins of the radiator; and a heat providing member attached to the fan shroud proximate the radiator, the heat providing member providing heat to the fan shroud and an exterior area of the radiator melting ice, snow and slush retained within the fan shroud and on an exterior surface of the radiator, the heat providing member running parallel and separate from the coolant hoses and the radiator.

2. The vehicle fan shroud de-icing assembly according to claim 1, wherein the vehicle engine includes coolant passageways connected to the coolant hoses that are connected to the radiator.

3. The vehicle fan shroud de-icing assembly according to claim 2, wherein the heat providing member includes a coolant flow pipe connected to the coolant passageways of the vehicle engine, the coolant passageways of the vehicle engine defining the heat source of the heat providing member, with coolant from the vehicle engine flowing through the coolant flow pipe.

4. The vehicle fan shroud de-icing assembly according to claim 3, wherein the coolant flow pipe receives coolant directly from the coolant passageways of the vehicle engine.

5. The vehicle fan shroud de-icing assembly according to claim 3, further comprising a coolant temperature sensor configured to measure temperature of coolant flowing through the coolant passageways of the vehicle engine;

a control valve located between the engine coolant passageways of the vehicle engine and the coolant flow pipe and being configured to switch between an open state allowing coolant flow from the engine coolant passageway to the coolant flow pipe and a closed state preventing coolant flow from the engine coolant passageway to the coolant flow pipe; and an electronic controller connected to the coolant temperature sensor and the control valve switching the control valve to the open state in response to predetermined criteria related to the measured coolant temperature.

6. The vehicle fan shroud de-icing assembly according to claim 3, wherein the coolant flow pipe includes a plurality of heat exchanging fins extending therefrom.

7. The vehicle fan shroud de-icing assembly according to claim 1, wherein the fan installed to the fan shroud defines an airflow direction when operating defining upstream and downstream relative to the airflow direction, and the heat providing member is installed to the fan shroud downstream of the radiator.

8. The vehicle fan shroud de-icing assembly according to claim 7, wherein the heat providing member is installed to the fan shroud below the fan.

9. The vehicle fan shroud de-icing assembly according to claim 7, wherein the fan includes fan blades that are at least partially encircled by a portion of the fan shroud, and the heat providing member is installed to the fan shroud downstream of the fan blades.

10. The vehicle fan shroud de-icing assembly according to claim 7, wherein the heat providing member is installed to the fan shroud below the fan blades.

11. The vehicle fan shroud de-icing assembly according to claim 1, wherein the heat providing member attached directly to a lower tank portion of the radiator.

12. The vehicle fan shroud de-icing assembly according to claim 11, wherein the coolant flow pipe includes a plurality of heat exchanging fins extending therefrom.

13. The vehicle fan shroud de-icing assembly according to claim 1, wherein the heat source of the heat providing member is an electric heater within the heat providing member.

14. The vehicle fan shroud de-icing assembly according to claim 13, wherein the electric heater is installed to a lower section of the fan shroud below the fan.

15. The vehicle fan shroud de-icing assembly according to claim 13, further comprising a coolant temperature sensor configured to measure temperature of coolant flowing through the coolant passageways of the vehicle engine; and an electronic controller connected to the coolant temperature sensor and the electric heater, the electronic controller being configured to operate the electric heater in response to predetermined criteria related to the measured coolant temperature.

* * * * *